United States Patent [19]

Sheesley et al.

[11] Patent Number: 4,666,231

[45] Date of Patent: May 19, 1987

[54] SWITCHING COAXIAL CONNECTOR

[75] Inventors: Wilmer L. Sheesley, Dauphin; William V. Pauza, Palmyra, both of Pa.

[73] Assignee: AMP Incorporated, N.J.

[21] Appl. No.: 878,767

[22] Filed: Jun. 26, 1986

[51] Int. Cl.[4] ..... H01R 17/18

[52] U.S. Cl. ..... 339/177 R; 339/19; 339/217 R

[58] Field of Search ..... 339/19, 177 R, 177 E, 339/222, 17 C, 17 LC, 147, 182, 183, 217 R; 200/51.09, 51.1

[56] References Cited

U.S. PATENT DOCUMENTS

| | | | |
|---|---|---|---|
| 3,166,649 | 1/1965 | Frantz et al. | 200/51.09 |
| 3,418,438 | 12/1968 | Barrett | 200/51.1 |
| 3,435,163 | 3/1969 | Bailey et al. | 200/51.1 |
| 4,307,926 | 12/1981 | Smith | 339/177 R |
| 4,426,558 | 1/1984 | Tanaka et al. | 200/51.09 |
| 4,602,833 | 7/1986 | Grabbe et al. | 339/19 |
| 4,609,242 | 9/1986 | Kemppainen | 339/177 R |

*Primary Examiner*—Eugene F. Desmond
*Assistant Examiner*—David Pirlot
*Attorney, Agent, or Firm*—Gerald K. Kita

[57] ABSTRACT

A switching coaxial connector comprises an insulative body constructed for slidable assembly with an inner contact, an outer shell, an intermediate contact, and a disconnect switch with switch pole contacts, one of the switch pole contacts having a clasp for slidable assembly with the outer shell, and the remainder of the contacts having respective blades that are bent outwardly from the remainder of the respective contacts to form electrical terminals.

6 Claims, 8 Drawing Figures

SWITCHING COAXIAL CONNECTOR

FIELD OF THE INVENTION

The invention relates to a coaxial connector with an internal electrical switch, and more particularly, to a coaxial connector with an internal electrical switch and constructed for slidable assembly of its component parts.

BACKGROUND OF THE INVENTION

A known coaxial connector is disclosed in U.S. Pat. No. 4,307,926 and comprises a conductive outer shell, a conductive inner contact, a conductive intermediate contact between the inner contact and the outer shell and an insulative body for assembly with the contacts and the outer shell. This known coaxial connector is constructed for assembly with a triaxial coaxial cable. It is sometimes advantageous to adapt a known coaxial connector of this type for mounting to a printed circuit board, PCB, instead of to a coaxial cable. Thus, the conductive contacts of the known connector can be adapted with external electrical terminals that project externally of the connector for mounting in apertures of a PCB. It is further advantageous in a PCB mounted connector of this type to provide a disconnect switch connected electrically between the intermediate connector and the outer shell.

The external electrical terminals and disconnect switch for the known coaxial connector requires an insulative body for electrically isolating the terminals one from the other. One known coaxial connector is fabricated by an injection molding process, wherein all of the conductive contacts and the disconnect switch are assembled first on a fixture, followed by enveloping the contacts within a insulative material that is molded to the desired form of an insulative body for the coaxial connector.

SUMMARY OF THE INVENTION

An aspect of the present invention resides in a switching coaxial connector adapted for PCB mounting. A disconnect switch is provided for connection with a conductive outer shell and an intermediate contact of the coaxial connector. The intermediate contact and the inner contact are provided with corresponding blades that project externally of the connector and form electrical terminals for mounting to a PCB. The disconnect switch is provided with blades that serve as switch pole contacts disengageably connected to the intermediate contact. The switch pole contacts have corresponding electrical terminals that project externally of the connector for mounting to a PCB.

An advantage of the invention resides in a switching coaxial connector in which an insulative body maintains the conductive parts of the connector electrically isolated from one another and is constructed with cavities for slidable assembly with the conductive parts of the connector.

According to another aspect of the invention, some of the blades have offset blade portions that are offset in respective planes of thickness of corresponding blades, and the insulative body is constructed for slidable assembly with corresponding offset blade portions.

An object of the invention is to provide a switching coaxial connector.

Another object of the invention is to provide a switching coaxial connector constructed for slidable assembly of the conductive parts in corresponding cavities of an insulative body of the connector.

Another object of the invention is to provide a switching coaxial connector constructed with electrical contacts having blades, switch pole contacts having blades and means for slidable assembly of the blades with the connector.

Another object of the invention is to provide a switching coaxial connector with electrical contacts having blades and switch pole contacts having blades, some of the blades having offset blade portions that are offset in respective planes of thickness of corresponding blades, and the insulative body being constructed for slidable assembly with corresponding offset blade portions.

Other advantages of the invention are apparent from a detailed description and accompanying drawings, that together disclose by way of example the aspects of the invention.

DESCRIPTION OF THE DRAWINGS

With more particular reference to the drawings, FIGS. 1 and 3 show a switching coaxial connector 1. A conductive and unitary electrical inner conductor 2 is formed by stamping and bending a unitary strip of metal. The inner conductor 2 is formed with an elongated split tube 3 having side by side separated spring fingers 4, 4 constructed for resilient radial deflection, radially of the tube 3, to serve as an electrical receptacle for disengageable coupling with an electrical plug portion of a complementary coaxial plug connector, not shown. The inner conductor 2 is formed further with an elongated blade 5 extending parallel to the axis of the receptacle 2. An end of the blade 5 serves an an electrical terminal 6.

Figure 1:
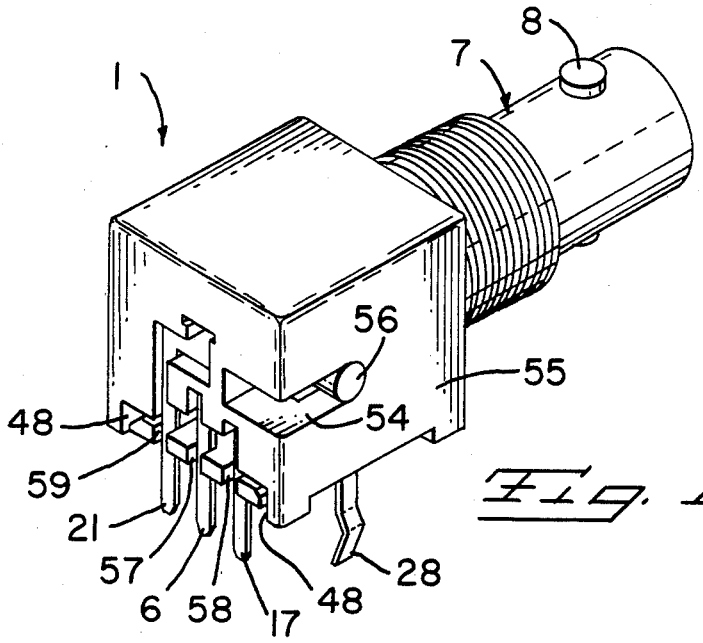
FIG. 1 is an enlarged perspective view of an electrical switching coaxial connector.

A conductive electrical outer shell 7 is of tubular form and has a pair of radially projecting prongs 8, 8 for a bayonet style coupling for disengageable coupling with a complementary coaxial plug connector, not shown. An end 9 of the outer shell has a cavity 10. An aperture 11 is provided through the side of the outer shell 7 adjacent the end 9.

A unitary and conductive electrical intermediate contact 12 is formed by stamping and bending a unitary strip of metal. The intermediate contact 12 is formed with an elongated split tubular shell portion 13 and a conductive elongated blade 14 extending parallel to the axis of the tubular shell portion 13. Elongated springs 15, 15 are incised from the thickness of the tubular shell portion 13 and remain integrally joined to the tubular shell portion 13. The springs 15, 15 are bowed radially outward of the tubular shell portion 13. The blade 14 has an offset blade portion 16 that is offset in the plane of thickness of the blade 14. The offset blade portion 16 joins the tubular shell portion 13 and the remainder of the blade 14. An end of the blade 14 serves as an elongated electrical terminal 17.

A unitary and conductive electrical switch pole contact 18 is formed by stamping a flat and unitary strip of metal. The switch pole contact 18 has an elongated blade 19 and an offset blade portion 20 offset in the plane of thickness of the blade 19. An end of the blade 19 serves as an electrical terminal 21. A pair of prongs 22, 22 project in the plane of thickness of the blade 19.

Another unitary and conductive electrical switch pole contact 23 is formed by stamping and bending a unitary strip of metal. An elongated blade 24 of the switch pole contact 23 extends from a clasp 25 having a spring finger 26, 26 on each side of the blade 24 and opposing a spring finger 27 of a width that spans from one spring finger 26 to the other 26 to provide opposed pairs of spring fingers 26, 27 adjacent each side of the blade 24 for gripping the end 9 of the outer shell 7 between the opposed pairs to establish an electrical connection. A pair of elongated electrical terminals 28, 28 project from the spring finger 27 and are bent to project in the same direction outwardly from the remainder of the clasp 25.

Figure 2:
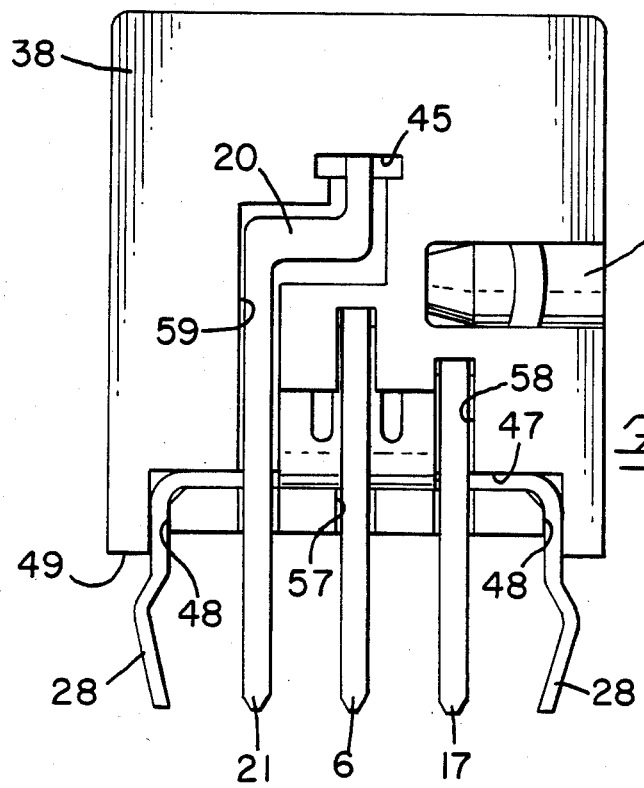
FIG. 2 is an enlarged end view of the connector shown in FIG. 1.
Figure 4:
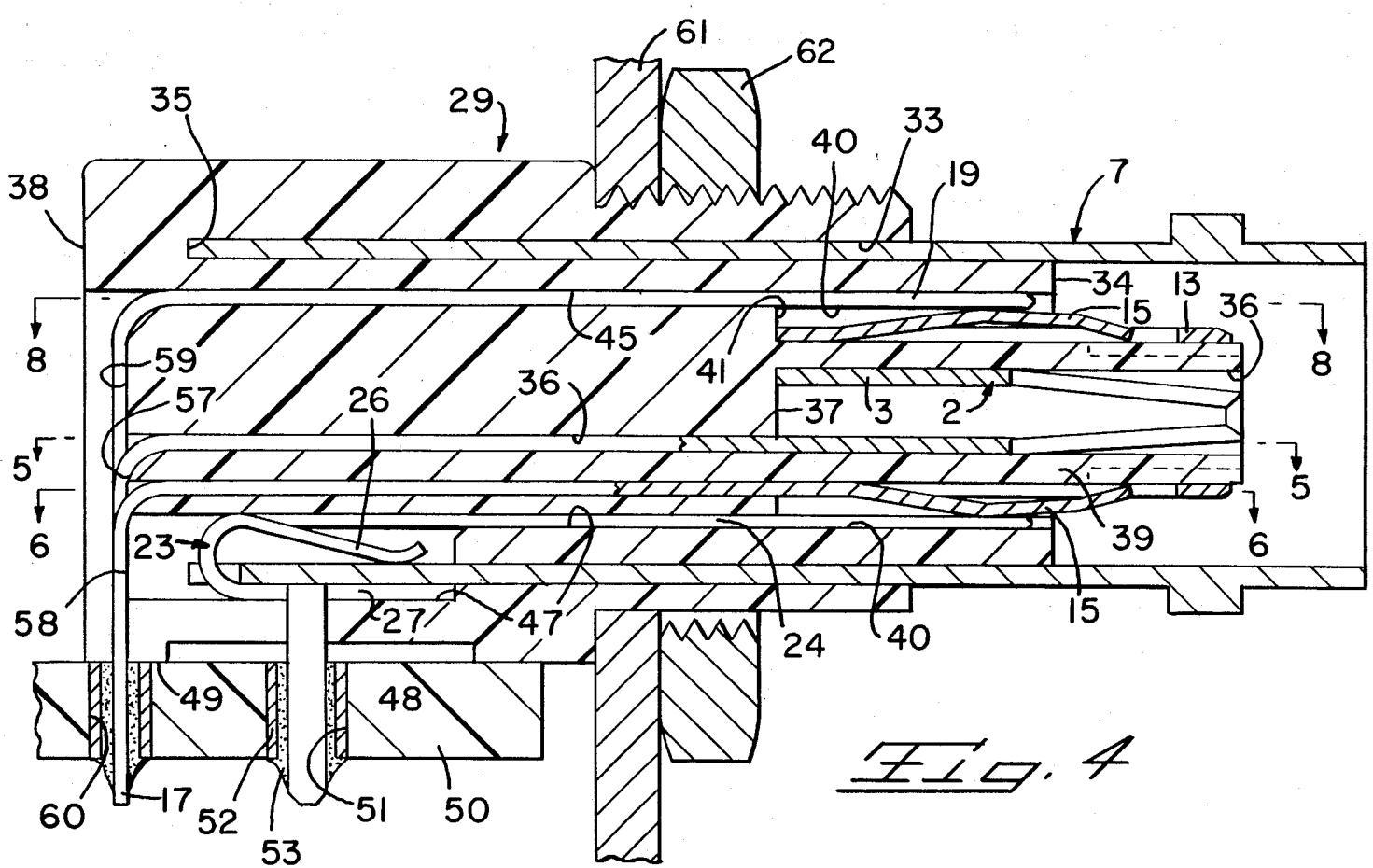
FIG. 4 is an enlarged elevation view in section of the connector shown in FIG. 1.
Figure 5:
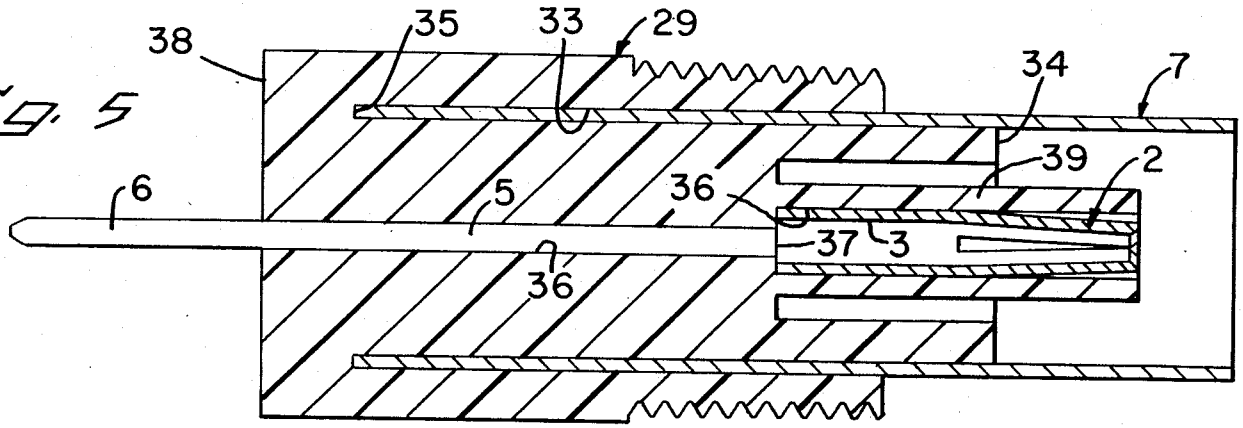
FIG. 5 is a section view taken along the line 5—5 of FIG. 4, with the line 5—5 assuming a nonlinear course, and with certain lines of the drawing omitted for purposes of illustration.

FIGS. 1 and 2 illustrate a unitary insulative body 29 that is advantageously molded from rigid plastics material and constructed with cavities that extend axially of the insulative body 29 for ease of manufacture by molding and for slidable assembly with the contacts 2, 12, 18, 23 and the outer shell 7. The insulative body 29 has a rectangular block portion 30 integral with a cylindrical portion 31 provided with external threads 32. FIG. 5 shows the outer shell 7 and inner contact 2 assembled in the insulative body 29. FIGS. 4 and 5 show an outer shell receiving cavity 33 extending axially of the insulative body 29 and communicating with an end 34 of the insulative body 29. The cavity 33 is constructed for slidable assembly with the outer shell 7 until the outer shell 7 seats against the bottom 35 of the cavity 33. The cavity 33 has a cross section that slidably receives and conforms to the inner and outer peripheries of the outer shell 7.

A center contact receiving cavity 36 extends axially of the insulative body 29 and is constructed for slidable assembly with the inner contact 2 until the tube 3 of the inner contact 2 is in registration against a shoulder 37 of the cavity 36. The cavity 36 has a cross section communicating with respective ends 34, 38 of the insulative body 29 and slidably receives and conforms to the outer periphery of the tube 3. A hollow cylindrical web 39 of the insulative body 29 concentrically encircles the tube 3. The cavity 36 has a further cross section extending axially of the insulative body 29 and constructed for slidable assembly with the blade 5 of the inner contact 2. The further cross section slidably receives and conforms to the periphery of the elongated portion of the blade 5. The electrical terminal 6 of the blade projects outwardly of the cavity 36.

Figure 6:
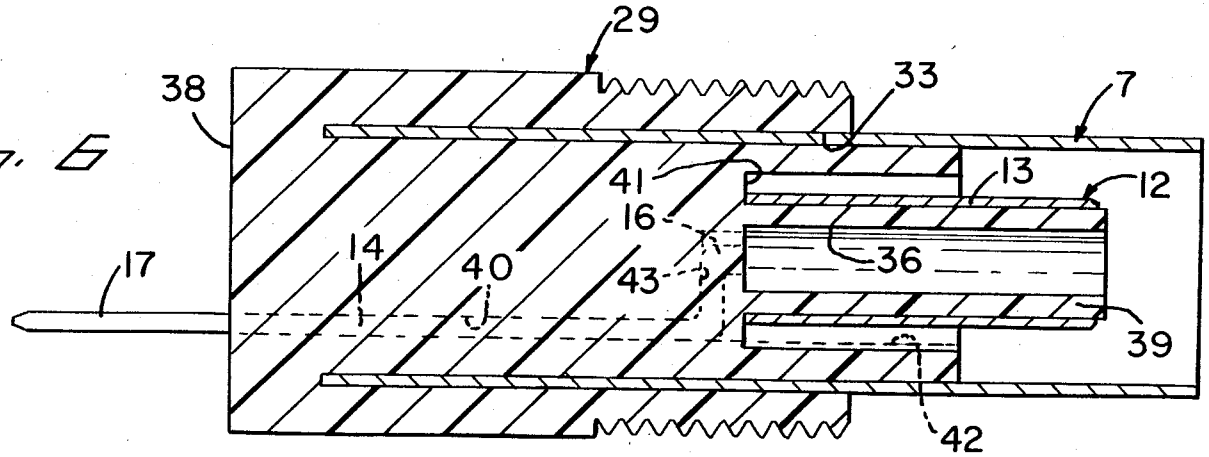
FIG. 6 is a section view taken along the line 6—6 of FIG. 4, with the line 6—6 assuming a nonlinear course, and with certain lines of the drawing omitted for purposes of illustration.

FIG. 6 shows the intermediate contact 12 assembled in the insulative body 29. FIGS. 4 and 6 show a cavity 40 extending axially of the insulative body 29 and constructed for slidable assembly with the intermediate contact 12. The cavity 40 has a first cross section of tubular cylindrical form concentrically encircling the web 39 and communicating with the end 34 of the insulative housing 29 and located concentrically between the outer shell receiving cavity 33 and the inner contact receiving cavity 36. The cavity 40 is constructed for slidable assembly with the tubular shell portion 13 until the same is in registration against a shoulder 41 of the cavity 40. The cavity 40 has a cross section that slidably receives and conforms to the periphery of the tubular shell portion 13.

Figure 7:
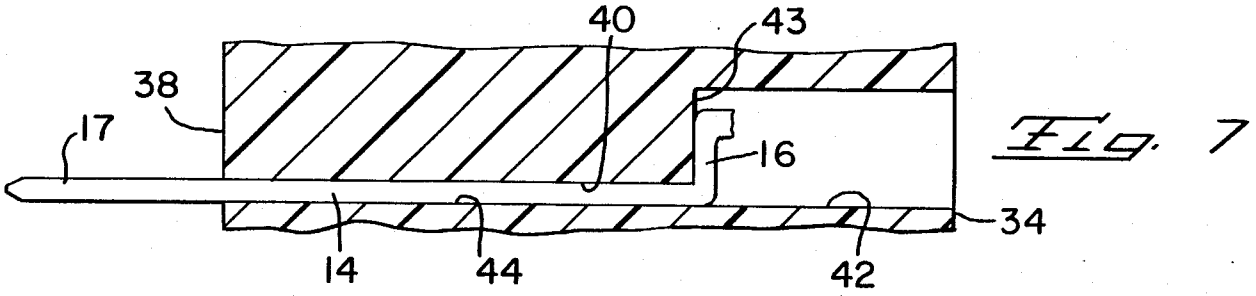
FIG. 7 is a section view taken along the line 7—7 of FIG. 4, with the line 7—7 assuming a nonlinear course, and with certain lines of the drawing omitted for purposes of illustration.

FIG. 7 shows the elongated blade 14 of the intermediate contact 12 with a part broken away and with the offset blade portion 16 assembled within the rectangular cavity 42. As shown in FIGS. 6 and 7 the cavity 40 has a further rectangular cross section 42 communicating with the end 34 of the insulative housing 39, extending axially of the insulative housing 29 until ending at a shoulder 43 and constructed for slidable assembly with the offset blade portion 16. The cavity 40 has a blade receiving cavity portion 44 communicating with the end of the insulative housing 29, extending axially of the insulative housing 29 and constructed for slidable assembly with the elongated blade portion 14. The corresponding cross sections of the cavity 42 slidably receive and conform to the corresponding peripheries of the offset blade portion 16 and the elongated portion of the blade 14. The electrical terminal 17 of the blade 14 projects outwardly of the cavity 40.

Figure 8:
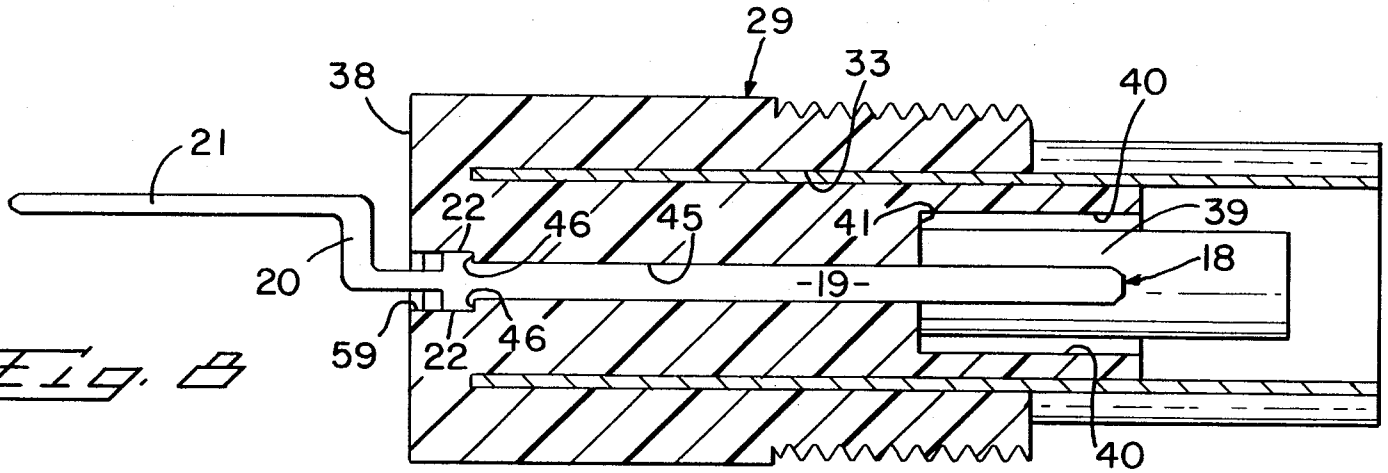
FIG. 8 is a section view taken along the line 8—8 of FIG. 4, with the line 8—8 assuming a nonlinear course, and with certain lines of the drawing omitted for purposes of illustration.

FIG. 8 shows the switch pole contact 18 assembled in the insulative body 29. FIGS. 4 and 8 show a blade receiving cavity 45 extending axially of the insulative housing 29 and constructed for slidable assembly with the elongated blade 19 of the switch pole contact 18 until the prongs 22, 22 are in registration against shoulders 46, 46 internally of the cavity 45. The cross section of the cavity 45 slidably receives and conforms to the periphery of the elongated portion of the blade 19. An enlarged cross section of the cavity 45 slidably receives and conforms to the combined peripheries of the prongs 22, 22 and the blade 19. The offset blade portion 20 and the terminal 21 project outwardly of the cavity 45. The cavity 45 communicates with the end 38 of the insulative housing 29. As shown in FIG. 4, the cavity 45 communicates with the cavity 40 surrounding the tubular shell portion 13 of the intermediate contact 12. The blade 19 in the cavity 45 is in alignment with a corresponding spring 15 in the cavity 40, thus to permit engagement and electrical connection between the blade 19 and the spring 15.

Figure 3:
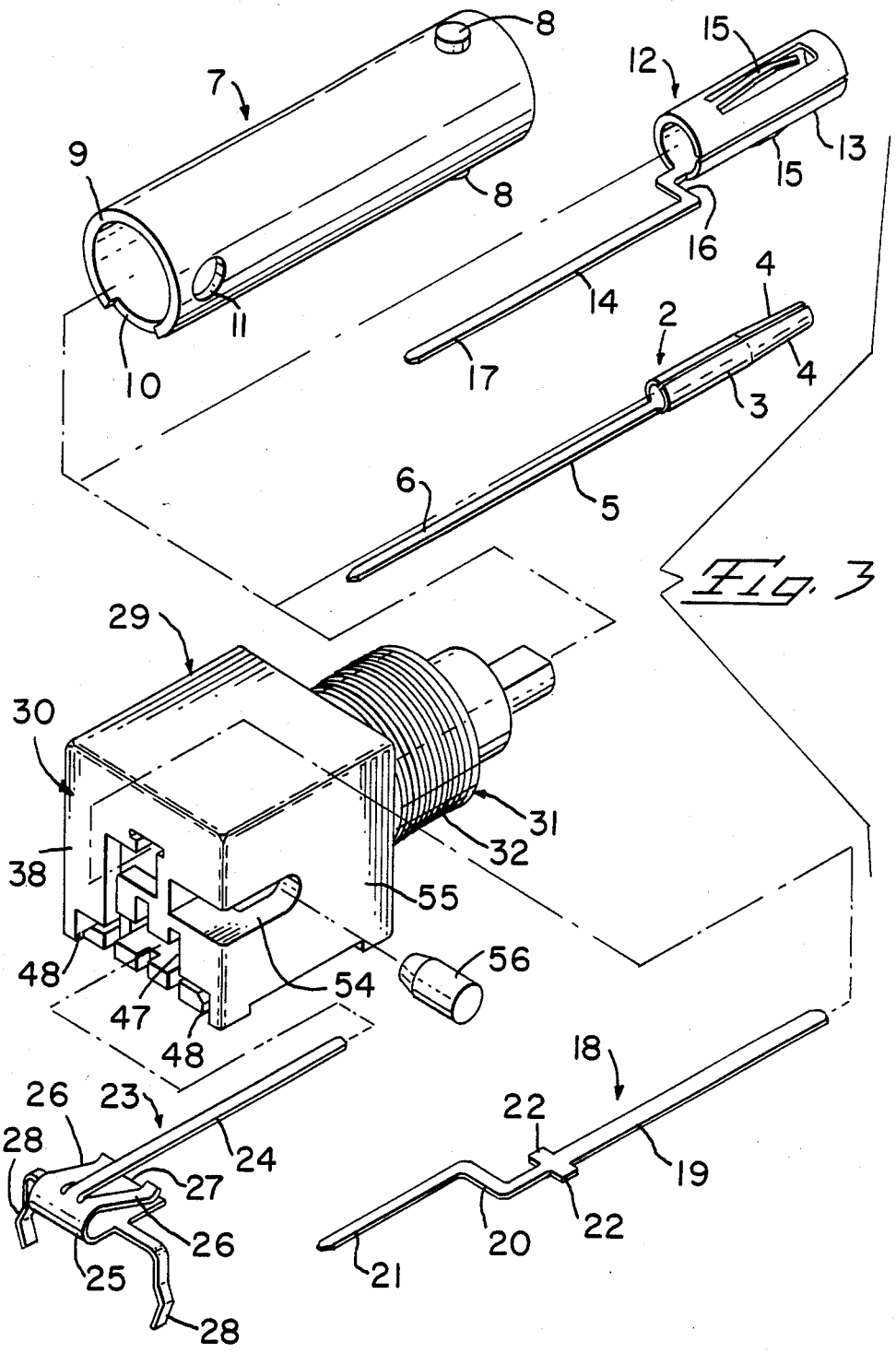
FIG. 3 is an enlarged perspective view of the connector shown in FIG. 1 with parts illustrated in exploded configuration.

FIGS. 2, 3 and 4 show a switch pole contact receiving cavity 47 communicating with the end 38 of the insulative housing 29. The cavity 47 extends axially of the insulative body 29 and communicates with the cavity 33 and is aligned with the end 9 of the outer shell 7 assembled in the cavity 33. The cavity 47 is constructed for slidable assembly with the switch pole contact 23. The cavity 47 extends in a direction axially of the insulative housing 29 and has a cross section that slidably receives and conforms to the periphery of the elongated portion of the blade 24. The cavity 47 communicates with the cylindrical cavity 40 surrounding the tubular portion 13 of the intermediate contact 12. The blade 24 in the cavity 47 is in alignment with a corresponding spring 15 in the cavity 40, thus to permit engagement and electrical connection between the blade 24 and the spring 15. An enlarged portion of the cavity 47 slidably receives the opposed pairs of spring fingers 26, 27. The fingers 26, 26, 27 register in the recess 10 and overlap and grasp the end 9 of the outer shell 7 located between opposed fingers 26, 27 of the corresponding pairs. Recesses 48, 48 intersect the end 38 and exterior bottom 49 of the block portion 30 and permit slidable assembly of the terminals 28, 28 into the block portion 30 and projection from the bottom exterior 49 and into corresponding apertures of a PCB 50, one of which apertures is shown at 51 lined with metal 52 that is connected with solder 53 to a corresponding terminal 28.

As shown in FIGS. 1 and 3, a channel 54 intersects the end 38 and a sidewall 55 of the block portion 30, and extends in a direction axially of the insulative housing 29 for a distance sufficient to communicate with the aperture 11 through the thickness of the outer shell 7. A pin 56 is received in the channel 54 and the aperture 11. The diameter of the pin 56 spans the width of the channel 54 and is prevented from displacement transverse to the width of the channel 54. The pin 56 anchors the outer shell 7 against rotation about its axis with respect to the insulative body 29.

As shown in FIGS. 1 and 2, electrical terminal receiving cavities 57, 58, 59 in the end 38 and the exterior bottom 49 extend axially of the insulative body 29 toward respective cavities 36, 40, 45 until communicating with the respective cavities 36, 40, 45. The electrical terminals 6, 17, 21 are bent out of their corresponding planes of thickness to project along the respective cavities 57, 58, 59 and to project externally of the exterior bottom 49, for example, for connection with corresponding apertures 60 of the PCB 50. The cavities 57, 58, 59 have respective shapes corresponding to the respective shapes of the terminals. As shown in FIG. 4, the cylindrical portion 31 may project through a panel 61 and a nut 62 secured onto the threads 32 and tightened against the panel 61.

Disconnect switching is accomplished upon insertion of an insulative sleeve, not shown, within an open end of the outer shell 7 and concentrically over the tubular shell portion 13, engaging and deflecting the springs 15, 15 radially inward of the tubular shell portion 13, and disengaging the springs 15, 15 from the corresponding blades 19, 24. Upon removal of the insulative sleeve, not shown, the springs 15, 15 will undergo return deflection, due to stored resilient spring energy, and engage the corresponding blades 19, 24.

The aspects of the invention have been described and illustrated, only by way of example, and may be embodied in further examples intended to be in and of the spirit and scope of the claims.

We claim:

1. A switching coaxial connector comprising;

a conductive electrical inner contact with an external electrical terminal, a conductive electrical outer shell concentrically encircling the inner contact, a conductive electrical intermediate contact between the inner contact and the outer shell and having an external electrical terminal, a disconnect switch having plural switch pole contacts disengageably connected to the intermediate contact, each switch pole contact having at least one exterior electrical terminal, an insulative body supporting said contacts and the outer shell, means connecting one of said switch pole contacts to the outer shell, said contacts having respective blades, corresponding ones of said blades each having an offset blade portion offset in the plane of thickness of a corresponding said blade, and blade receiving cavities extending axially of the insulative body and constructed with respective first portions having cross sections constructed for slidable assembly with peripheries of respective elongated portions of said blades, a second portion of one of said cavities communicating with an end of the insulative body and having a cross section constructed for slidable assembly with peripheries of a corresponding offset blade portion and a corresponding remainder of one of said contacts.

2. A switching coaxial connector as recited in claim 1 wherein, some of said blades are said switch pole contacts, and some of said blades provide said terminals.

3. A switching coaxial connector as recited in claim 1 wherein, said one of said cavities has a third portion communicating with said second portion and said first portion, respectively, and constructed for slidable assembly with a corresponding said offset blade portion.

4. A switching coaxial connector as recited in claim 1 wherein, said intermediate contact is comprised of a shell portion of said one of said contacts, said insulative body has a hollow cylindrical portion concentrically encircled by said shell portion, and said second portion of said one of said cavities comprises a cavity communicating with one end of said insulative body and constructed for slidable assembly with said shell portion.

5. A switching coaxial connector as recited in claim 1 wherein, a contact receiving cavity communicates with a second of said cavities and with one end of said insulative body and is constructed for slidable assembly with said center contact.

6. A switching coaxial connector as recited in claim 1 wherein, said means is a clasp constructed for slidable assembly with said outer shell.

* * * * *